United States Patent [19]

Suzuki

[11] Patent Number: 4,697,985

[45] Date of Patent: Oct. 6, 1987

[54] GAS TURBINE VANE

[75] Inventor: Isamu Suzuki, Yokohama, Japan

[73] Assignee: Kabushiki Kaisha Toshiba, Kawasaki, Japan

[21] Appl. No.: 708,801

[22] Filed: Mar. 6, 1985

[30] Foreign Application Priority Data

Mar. 13, 1984 [JP] Japan ..... 59-47544

[51] Int. Cl.[4] ..... F01D 5/18

[52] U.S. Cl. ..... 416/97 R; 416/96 A; 415/115

[58] Field of Search ..... 415/115; 416/95, 96 R, 416/96 A, 97 R

[56] References Cited

U.S. PATENT DOCUMENTS

| | | | |
|---|---|---|---|
| 3,388,888 | 6/1968 | Kercher et al. | 416/97 |
| 3,574,481 | 4/1971 | Pyne | 416/97 |
| 3,726,604 | 4/1973 | Helms et al. | 415/115 |
| 3,809,494 | 5/1974 | Redman | 416/97 |
| 4,183,716 | 1/1980 | Takahara et al. | 416/97 |
| 4,407,632 | 10/1983 | Liang | 415/115 |
| 4,437,810 | 3/1984 | Pearce | 416/97 |

FOREIGN PATENT DOCUMENTS

| | | | |
|---|---|---|---|
| 2290573 | 6/1976 | France | 416/97 |
| 51-69707 | 6/1976 | Japan . | |
| 51-34925 | 9/1976 | Japan . | |

*Primary Examiner*—Robert E. Garrett
*Assistant Examiner*—John Kwon
*Attorney, Agent, or Firm*—Schwartz, Jeffery, Schwaab, Mack, Blumenthal & Evans

[57] ABSTRACT

A gas turbine vane generally comprises an outer hollow vane member provided with a plurality of ribs aligned on the inner wall of the outer vane member and an insertion member of vane shape inserted into the outer hollow vane member so as to rigidly engage with the ribs. A turbulence chamber is defined between the leading edge portions of the outer and inner vane members, and the inner hollow insertion member is provided with numerous orifices at its leading edge portion for injecting cooling fluid into this turbulence chamber. A plurality of cooling passages operatively connected to the turbulence chamber are formed between the flank walls of the outer and inner vane members, and a plurality of orifices are further provided through the flank walls of the inner insertion member so as to communicate the interior thereof with the cooling passages.

10 Claims, 6 Drawing Figures

GAS TURBINE VANE

BACKGROUND OF THE INVENTION

This invention relates generally to gas turbine vanes provided with cooling means and more particularly to a gas turbine vane which is cooled by a so-called gas collision cooling system in which air jets are blown at high velocity against parts such as the inner surface of the vane leading edge thereby to increase the cooling effect (as disclosed, for example, in Japanese Patent Laid-Open Publication No. 69708/1976).

A gas turbine vane generally comprises an outer hollow member in vane shape and an inner hollow member inserted into the hollow portion of the outer vane member, and a plurality of rib-like projection members (hereinafter called rib or ribs) are integrally formed on the inner wall side of the outer vane member in the vane chord direction and disposed in a row in the spanwise or radial direction to form cooling passages. The inner hollow insertion member is rigidly engaged with these ribs when it is fitted in the outer vane member, and under the thus inserted condition, a turbulence chamber is defined between the leading edge portion of the outer vane member and the leading edge portion of the insertion member.

With the general construction of the gas turbine vane as described above, when it is required to cool the turbine vane, a gas collision type vane cooling method is adopted as the vane cooling method. In this method the gas turbine vane is cooled by a gas, usually air, ejected from the outlet of a compressor. More particularly, a high speed air jet from the compressor is injected into the inner hollow member inserted into the outer vane member and then jetted into the turbulence chamber through holes formed through the leading edge portion of the insertion member thereby to cool the inner wall of the leading edge portion of the outer vane member to forcibly cool that portion by the air collision cooling effect.

The air after collision is then guided into cooling passages formed between the flank walls of the outer vane member and the inner insertion member to cool the entire flank wall of the outer vane member and is finally exhausted through exhaust holes formed at the trailing edge portion of the outer vane member.

With the gas turbine vane provided with the vane cooling means of the type described above, it is necessary to supply a relatively large amount of cooling air in order to maintain the temperature of the turbine vane below the allowable temperature. The feeding of a large amount of the cooling air indeed improves the vane cooling efficiency, but on the other hand, the temperature of a gas acting on the turbine vane is also lowered thereby undesirably lowering the output efficiency of the gas turbine. In view of these problems, a gas turbine vane provided with an improved vane cooling means consuming a relatively small amount of cooling air has been desired.

SUMMARY OF THE INVENTION

An object of this invention is to overcome the problems of the prior art technique and to provide an improved gas turbine vane with cooling means capable of effectively cooling the entire wall of the turbine vane with a relatively small amount of cooling air.

For achieving this and the other objects, according to this invention, there is provided a gas turbine vane of the type comprising a hollow outer vane member of vane shape provided with a plurality of projections aligned on the inner wall surface of the outer vane member and extending in the vane chord direction thereof, and an inner hollow member inserted into the outer vane member so that the inner insertion member is rigidly engaged with the projections when the insertion member is fitted into the outer vane member, a turbulence chamber being defined between the leading edge portion of the outer vane member and the leading edge portion of the inner insertion member, a plurality of orifices being formed through the leading edge portion of the inner insertion member to open into the turbulence chamber, and a plurality of cooling passages defined between the outer vane member, the inner insertion member, and the projections of the outer vane member and communicated with the turbulence chamber, the gas turbine vane being further provided with a plurality of orifices formed through the flank walls of the inner insertion member to communicate with the cooling passages.

In a modification of the preferred embodiment of the gas turbine vane of this invention, gas flow rate regulating members are further provided in the cooling passages, respectively, and in addition, a plurality of tiered slots are formed through a flank wall of the outer vane member so as to communicate with the cooling passages.

According to the preferred embodiment of this invention, the inner wall surface of the outer vane member of the gas turbine vane is cooled by the cooling air collision effect due to the cooling air injected through the orifices formed through the flank walls of the inner insertion member and, in addition, by the cooling air circulation effect due to the cooling air flowing through the cooling passages, with a relatively small amount of cooling air.

In addition, the provision of the air flow rate regulating members in the cooling passages can improve the air flow effect so that a relatively high temperature portion of the flank walls of the outer vane member is cooled with a relatively large amount of the cooling air, and a relatively low temperature portion thereof is cooled with a relatively small amount of cooling air. Moreover, a plurality of tiered slots are formed through the outer vane member to attain a so-called film cooling effect.

Consequently, according to this invention, the entire flank walls of the outer vane member of the gas turbine vane can be effectively cooled with a relatively small amount of cooling air.

DESCRIPTION OF THE PREFERRED EMBODIMENTS

Figure 1:
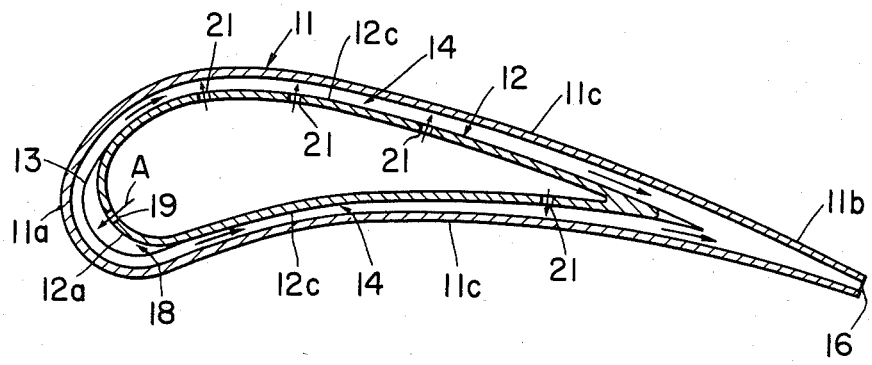
FIG. 1 is a cross-sectional or profile view of one embodiment of a gas turbine vane according to this invention.

FIG. 1 shows a cross-sectional view of one embodiment of a gas turbine vane according to this invention, which generally comprises an outer hollow member 11 in vane shape and an inner hollow insertion member 12 also in vane shape disposed in the inner hollow portion of the outer vane member 11 with a specific space therebetween. The outer vane member 11 is of course provided with an outer configuration and strength required for a gas turbine vane. On the inner wall surface of the outer vane member 11 are formed a plurality of rib-like projecting members (hereinbelow called rib or ribs) 13 extending in the vane chord direction of the outer vane member 11. The insertion member 12 is rigidly engaged with the ribs 13 when it is fitted in the outer vane member 11, and the trailing edge portion of the insertion member 12 is secured to a vane cover, not shown. Passages 14 for cooling gas, usually air, are defined by and between adjacent ribs 13, the inner wall surface of the outer vane member 11 and the outer wall surface of the insertion member 12, and the thus defined cooling passages 14 are formed on the inner wall surface of the outer vane member 11. These cooling passages 14 are all interconnected at the trailing edge portion 11*b* of the outer vane member 11 and communicated with air exhaust ports 16 formed at the trailing edge portion 11*b*. The leading edge portion 12*a* of the insertion member 12 is not connected to the ribs 13 formed at the inner wall of the leading edge portion 11*a* of the outer vane member 11 so that a turbulence chamber 18 is defined therebetween, and the turbulence chamber 18 is communicated with the cooling passages 14.

A plurality of orifices 19 are formed at the leading edge portion 12*a* of the insertion member 12 so as to forcibly jet the cooling air fed inside the insertion member 12 into the turbulence chamber 18 through the orifices 19. A plurality of additional orifices 21 communicating with the cooling passages 14 are formed through the flank walls 12*c* of the insertion member 12 at positions corresponding to those of the flank walls 11*c* of the outer vane member 11 at which the surface temperature is relatively high. The orifices 21 are formed so as to be directed toward the inner flank wall 11*c* of the outer vane member 11 thereby to cause jets of the cooling air to collide thereagainst.

According to the construction shown in FIG. 1 and described above, the cooling air fed into the insertion member 12 from the compressor is jetted into the turbulence chamber 18 through the orifices 19 as shown by an arrow A in FIG. 1 to forcibly cool the inner wall of the leading edge portion 11*a* of the outer vane member 11 by a so-called collision cooling effect. The cooling air thus jetted into the turbulence chamber 18 then flows through the cooling passages 14 thereby to circulatingly cool the flank wall 11*c* of the outer vane member 11. The flank wall 11*c* is additionally cooled by the collision cooling effect of air jets ejected through the orifices 21 formed through the flank wall 12*c* of the insertion member 12. Thus, the flank wall 11*c* is forcibly cooled by the combination of the cooling air flow through the cooling passages 14 and the collision cooling effect of the air ejected through the orifices 21. The cooling air which has been used for the cooling of the outer vane member 11 is then exhausted outwardly through the exhaust holes 16 formed on the trailing edge portion of the outer vane member 11.

Thus, according to this invention, the portions of the flank wall of the outer vane member at which the temperature is considered to be high can be forcibly cooled by the combination of the circulation cooling and collision cooling, thus achieving an improved cooling effect with a relatively small amount of cooling air.

Figure 2:
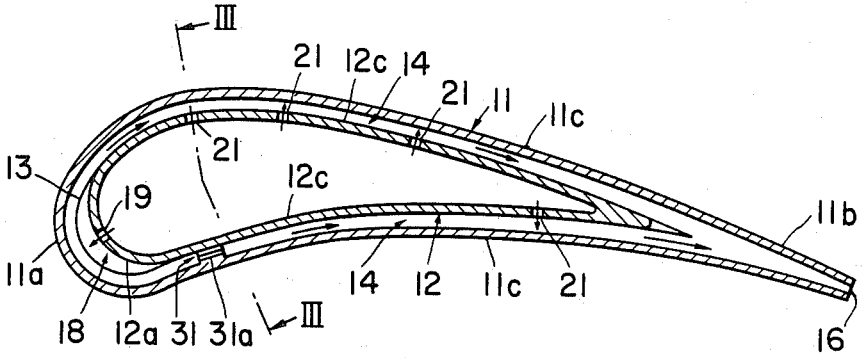
FIG. 2 is also a cross-sectional view of another example of a gas turbine vane of this invention.

With reference to the illustration of FIG. 2, another embodiment of this invention will be described hereinbelow. In FIG. 2, like reference numerals are used to designate those parts which are the same as corresponding parts in FIG. 1.

The gas turbine vane shown in FIG. 2 also comprises an outer hollow vane member 11 provided with a plurality of ribs 13 on the inner wall thereof extending parallelly in the vane chord direction and an inner hollow insertion member 12 fitted in the outer vane member 11 so as to rigidly engage with the ribs 13. A turbulence chamber 18 is defined between the inner wall of the leading edge portion 11*a* of the outer vane member 11 and the outer wall of the leading edge portion 12*a* of the insertion member 12, and a plurality of orifices 19 are formed through the leading edge portion 12*a* to be opened towards the turbulence chamber 18. A plurality of orifices 21 also formed through the flank wall 12*c* of the insertion member 12 are communicated with cooling passages 14 provided between the outer vane member 11 and the inner insertion member 12.

In the example shown in FIG. 2, members 31 for regulating air flow rate are disposed within the cooling passages 14, respectively, and each is provided with throttling structure for reducing the cross-sectional area of the air stream flowing through the cooling passage 14 to regulate the air flow condition so that a relatively large amount of cooling air will flow at the relatively high temperature portions of the wall of the outer vane member 11, while a relatively small amount of cooling air will flow at the relatively low temperature portions thereof.

Figure 3:
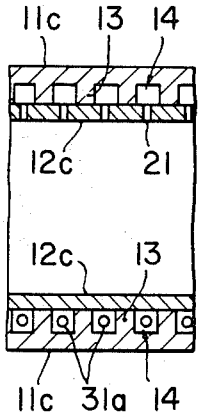
FIG. 3 is a partial sectional view taken along the line III—III shown in FIG. 2.

Each flow rate regulating member 31 is constructed by forming an orifice 31*a* in the wall so as to partially interrupt the cooling passage 14 as best shown in FIG. 3.

According to the embodiment of this invention shown in FIGS. 2 and 3, the inner wall surface of the outer vane member 11 is effectively cooled by the collision cooling of the cooling air ejected through the orifices 21, and in addition, the cooling air flowing from the turbulence chamber 18 into the cooling passages 14 can be regulated in such a distributed manner that a relatively large amount of the cooling air will flow at the relatively high temperature portions of the wall of the outer vane member 11 and a relatively small amount of the cooling air will flow at the relatively low temperature portions thereof, whereby the entire wall of the outer vane member 11 is effectively cooled with a regulated relatively small amount of cooling air.

Figure 4:
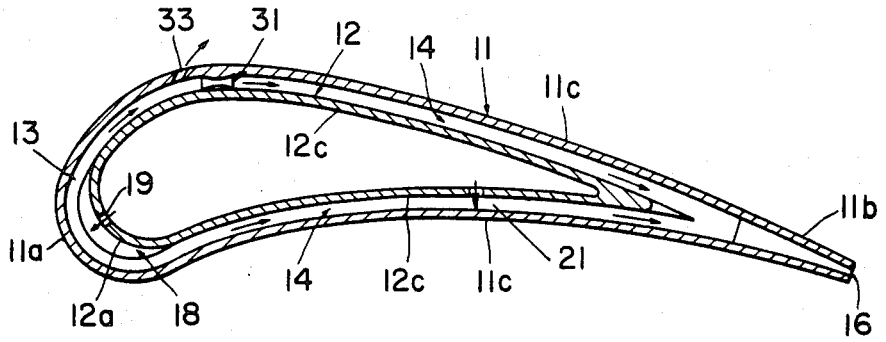
FIG. 4 is a cross-sectional view of further example of a gas turbine vane of this invention.

FIG. 4 shows a further embodiment of the gas turbine vane of this invention, in which, with respect to the cooling mechanism of the gas turbine vane shown in FIG. 2, a so-called film cooling system has been partly added. Those parts in FIG. 4 which are the same as or equivalent to corresponding parts in FIG. 2 are designated by like reference numerals.

The example shown in FIG. 4 is provided with further cooling means in addition to the vane cooling means represented by the example shown in FIG. 2. This cooling means consists of a plurality of slots 33 formed for film cooling through the flank wall 11*c* of the outer vane member 11 so as to be communicated with the cooling passages 14 to attain the film cooling effect. It is desirable to form the slots 33 at portions just in front of the air flow rate regulating members 31.

According to the embodiment of the invention shown in FIG. 4, the inner wall of the leading edge portion of the outer vane member 11 is forcibly cooled by the cooling air jetted through the orifices 19 formed at the leading edge portion 12*a* of the insertion member 12, and, in addition, a part of the cooling air introduced into the cooling passages 14 with regulated flow amount and distributed by the flow amount regulating member 31 is caused to flow out through the slots 33 thereby to cool the outer wall surface of the outer vane member 11 to attain the film cooling effect. Moreover, the inner side wall of the outer vane member 11 can be effectively cooled by the collision cooling of the air jetted through the orifices 21 of the insertion member 12 in combination with the circulation cooling of the air flowing through the cooling passages 14. Thus, the gas turbine vane can be effectively and amply cooled with a relatively small amount of regulated cooling air in relation to the vane temperature.

Figure 5:
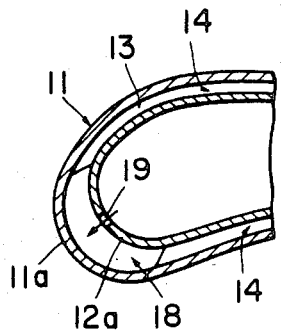
FIGS. 5 and 6 are also cross-sectional views of parts of gas turbine vanes constituting still further examples of this invention.

FIG. 5 shows a part of a further embodiment of this invention, in which a rib or ribs 13 are not provided for the inner wall of the leading edge portion 11*a* of the outer vane member 11 to define a more wide turbulence chamber 18 between the leading edge portions 11*a* and 12*a* of the outer vane member 11 and the inner insertion member 12. With this construction of the gas turbine vane, the inner wall surface of the leading edge portion 11*a* of the outer vane member 11 can be more effectively cooled by the direct collision of the cooling air jetted through the orifices 19 formed through the leading edge portion 12*a* of the insertion member 12.

Figure 6:
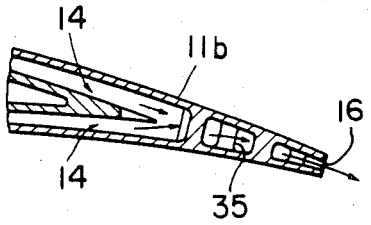

FIG. 6 shows a part of a still further embodiment of this invention, in which a plurality of pin fins 35 are disposed across the upper and lower inner walls of the outer vane member 11 near the trailing edge portion 11*b* thereof to cause turbulence flow of the cooling air passed through the cooling passages 14 thereby to effectively cool the trailing edge portion of the outer vane member 12 of the gas turbine vane.

As described hereinabove, according to the embodiments of this invention, the gas turbine vane, i.e., the leading and trailing edge portions, and the inner wall surfaces of the outer vane member of the gas turbine vane, can be effectively cooled with a relatively small amount of cooling air, even when the outer surface of the gas turbine vane is heated to a relatively high temperature.

What is claimed is:

1. A gas turbine vane comprising:

an outer vane member of hollow vane shape having flank walls, an exterior surface and an inner wall surface, the inner wall surface having a plurality of spaced-apart projections thereon extending in a vane chordwise direction;

an insertion member of hollow shape having flank wall parts and being inserted into said outer vane member and tightly engaged with said projections;

a turbulence chamber formed between said outer vane member at a leading edge part thereof and said insertion member;

means for carrying cooling fluid from said turbulence chamber to a plurality of rear exhaust ports, said carrying means comprising a plurality of cooling passages which are laterally distinct from one another formed between said outer vane member, said insertion member, and said projections;

first fluid injection means for injecting fluid into said turbulence chamber;

second fluid injection means positioned intermediate between said turbulence chamber at the flank wall parts of said insertion member and said exhaust ports for feeding injecting fluid into each of said cooling passages to further cool a trailing edge portion of said outer vane member;

flow restricting means disposed in each of said cooling passages to control the length of time spent by said fluid in said turbulence chamber and to control the pressure of said fluid in said turbulence chamber; and means for film cooling the exterior surface of said outer vane member, said film cooling means including a plurality of slots positioned at the flank wall of said outer vane member and means for allowing one-way flow of fluid between said cooling passages and the exterior surface of said outer vane member.

2. A gas turbine vane according to claim 1, wherein said one-way flow allowing means comprises said cooling passages and said flow restricting means.

3. The gas turbine vane according to claim 1 in which the second injection means are adapted to inject the cooling fluid against the inner surface of the flank walls of the outer vane member.

4. The gas turbine vane according to claim 1 wherein said flow rate regulating means comprises a throttling member for reducing the cross-sectional area of said cooling passage.

5. The gas turbine vane according to claim 4 wherein said throttling member is constituted by a throttling orifice.

6. The gas turbine vane according to claim 1 wherein said tiered slots are formed at positions of the flank wall of said outer vane member in front of said fluid flow rate regulating means.

7. The gas turbine vane according to claim 1 wherein said projections are provided only on the inner flank walls of said outer vane member.

8. The gas turbine vane according to claim 1 wherein a plurality of fin members are further provided for portions near the trailing edge portions of said outer vane member.

9. The gas turbine vane according to claim 1, wherein said projections are provided on both the inner wall of the leading edge portion and the inner flank walls of said outer vane member.

10. The gas turbine vane according to claim 1, wherein said flow rate regulating means is positioned between said first and said second invention means.

* * * * *